US008121529B2

(12) United States Patent
Maruyama

(10) Patent No.: US 8,121,529 B2
(45) Date of Patent: Feb. 21, 2012

(54) SHEET TRANSPORT APPARATUS AND FIXING APPARATUS

(75) Inventor: Shinji Maruyama, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/873,655

(22) Filed: Sep. 1, 2010

(65) Prior Publication Data

US 2010/0322683 A1 Dec. 23, 2010

Related U.S. Application Data

(63) Continuation of application No. 11/947,418, filed on Nov. 29, 2007, now Pat. No. 7,813,687.

(60) Provisional application No. 60/867,930, filed on Nov. 30, 2006.

(51) Int. Cl.
*G03G 15/20* (2006.01)

(52) U.S. Cl. ..... 399/329; 271/226; 270/1.01

(58) Field of Classification Search ..... 399/328–331, 399/333; 271/226; 270/1.01
See application file for complete search history.

(56) References Cited

U.S. PATENT DOCUMENTS 5,984,848 A * 11/1999 Hyllberg et al. ..... 492/46
2006/0198671 A1* 9/2006 Kawahata ..... 399/329
2007/0286618 A1 12/2007 Maruyama

FOREIGN PATENT DOCUMENTS

JP 2003-057895 2/2003
JP 2004-272255 9/2004

OTHER PUBLICATIONS

U.S. Office Action dated Mar. 5, 2010 corresponding to U.S. Appl. No. 11/947,418 filed on Nov. 29, 2007.

* cited by examiner

*Primary Examiner* — David Gray
*Assistant Examiner* — Ruth Labombard
(74) *Attorney, Agent, or Firm* — Turocy & Watson, LLP

(57) ABSTRACT

A sheet transport technique of clamping and transporting a sheet by a roller and a belt abutted against the roller, the technique capable of suppressing shift of the belt in the rotation axis direction of the roller without hindering downsizing of the apparatus is provided. A sheet transport apparatus is made up of a roller 101 being formed with a tubular cavity having a predetermined length in a rotation direction and covered with an elastic body on the outer periphery in the rotation radius direction of the cavity and a belt unit 102 for abutting a belt 102*c* of a width narrower than the width of the cavity in the rotation axis direction of the roller 101 against the roller face of the roller 101 so that it is positioned inside the range in which the cavity is formed in the rotation axis direction of the roller 101, and sandwiching a sheet 7 between the belt 102*c* and the roller 101 and transporting the sheet.

12 Claims, 4 Drawing Sheets

SHEET TRANSPORT APPARATUS AND FIXING APPARATUS

CROSS-REFERENCE TO RELATED APPLICATIONS

This application is a Continuation of application Ser. No. 11/947,418 filed on Nov. 29, 2007, which claims the benefit of priority from Provisional application Ser. No. 60/867,930 filed on Nov. 30, 2006, the entire contents of both of which are incorporated herein by reference.

BACKGROUND OF THE INVENTION

1. Field of the Related Art

The present invention relates to a sheet transport technique of clamping and transporting a sheet by a roller and a belt abutted against the roller.

2. Description of the Related Art

Hitherto, a fixing apparatus, etc., included in an image formation apparatus has adopted a sheet transport technique of clamping and transporting a sheet by a roller and a belt abutted against the roller. (For example, refer to U.S. Pat. No. 6,819,904.)

In the related art, to prevent the belt pressed against the roller from shifting in the rotation axis direction of the roller, it is a common practice to add special parts such as a shift prevention plate at both ends in the rotation axis direction of the roller.

Adding such special parts for shift prevention causes a problem because of hindering downsizing of the apparatus.

SUMMARY OF THE INVENTION

It is an object of the invention to provide a sheet transport technique of clamping and transporting a sheet by a roller and a belt abutted against the roller, the technique capable of suppressing shift of the belt in the rotation axis direction of the roller without hindering downsizing of the apparatus.

To solve the above-described problems, according to one aspect of the invention, there is provided a sheet transport apparatus including a roller being formed with a tubular cavity having a predetermined length in a rotation direction and covered with an elastic body on the outer periphery in the rotation radius direction of the cavity; and a belt unit for abutting a belt of a width narrower than the width of the cavity in the rotation axis direction of the roller against a roller face of the roller so that it is positioned inside the range in which the cavity is formed in the rotation axis direction of the roller, and sandwiching a sheet between the belt and the roller and transporting the sheet.

According to one aspect of the invention, there is provided a fixing apparatus having a sheet transport apparatus of the configuration as described above; and a roller heating unit being placed in the proximity of the roller face of the roller for heating the roller face.

According to one aspect of the invention, there is provided a fixing apparatus having a sheet transport apparatus of the configuration as described above; and a belt heating unit being placed on a side of the belt in the belt unit not opposed to the roller face for heating a sheet to be transported through the belt.

DESCRIPTION OF THE PREFERRED EMBODIMENTS

Referring now to the accompanying drawings, there are shown embodiments of the invention.

First Embodiment

To begin with, a sheet transport apparatus and a fixing apparatus including the sheet transport apparatus according to a first embodiment of the invention will be discussed.

Figure 1:
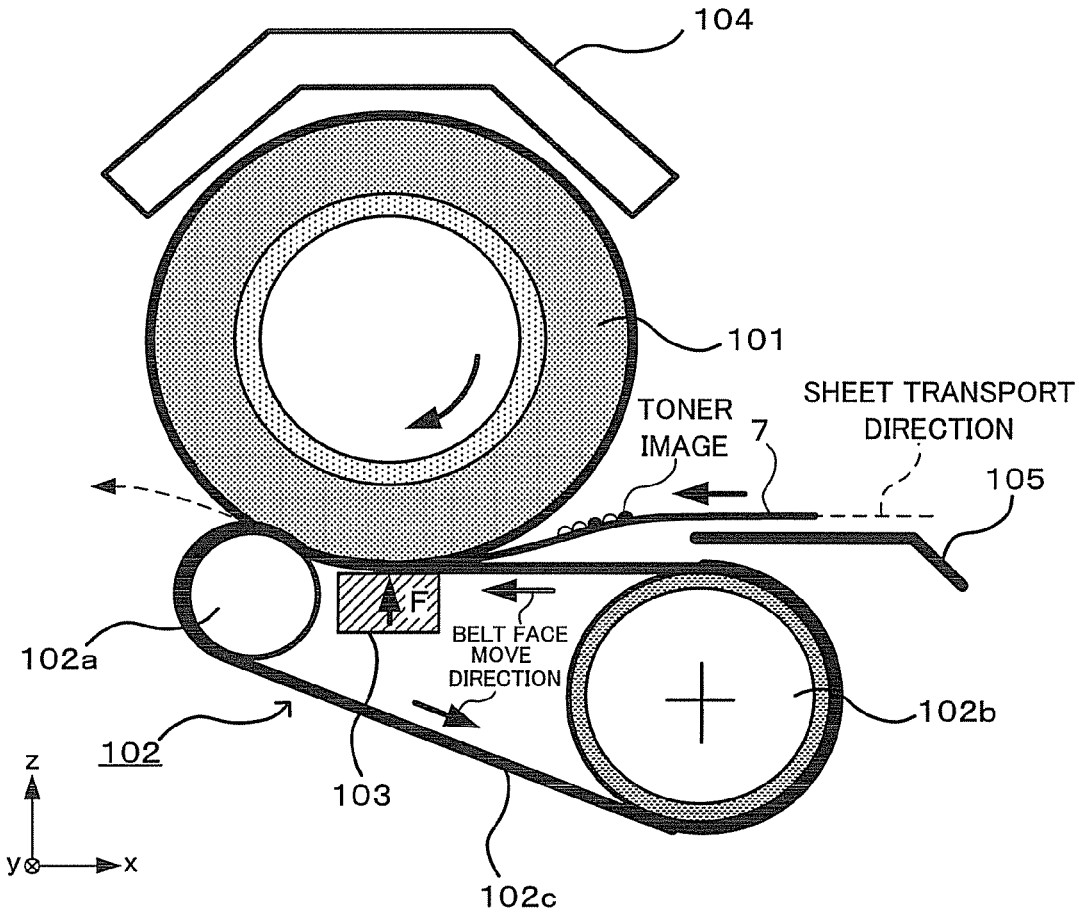
FIG. 1 is a drawing to show the configuration of a fixing apparatus including a sheet transport apparatus according to a first embodiment of the invention.

FIG. 1 is a drawing to show the configuration of the fixing apparatus including the sheet transport apparatus according to the first embodiment of the invention.

As shown in FIG. 1, the fixing apparatus according to the embodiment is made up of a roller 101, a belt unit 102, a press unit 103, an induction heating coil 104, and a transport guide 105. According to the configuration as shown in the figure, the fixing apparatus according to the embodiment clamps a sheet with an image formed thereon in a developer of toner, etc., by the roller 101 and the belt unit 102 and heats and fixes the developer image on the sheet.

In the fixing apparatus according to the embodiment, the roller 101 has a role as a heat roller and the belt unit 102 has a role in pressing the sheet against a roller face of the roller 101 heated by the induction heating coil 104. The induction heating coil 104 is placed in the proximity of the roller face of the roller 101 for heating the roller face.

Figure 2:
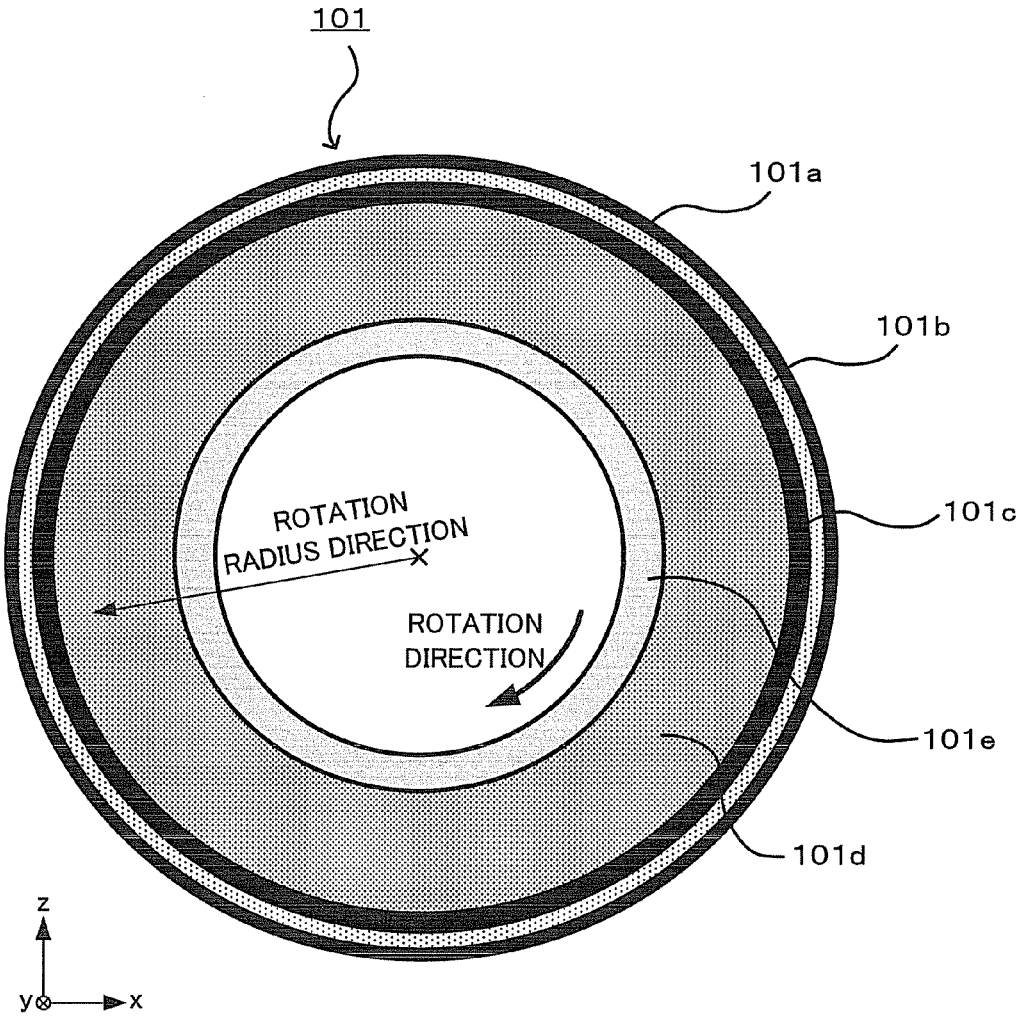
FIG. 2 is a drawing to show the cross section of a roller 101 on a plane orthogonal to the rotation axis of the roller 101.
Figure 3:
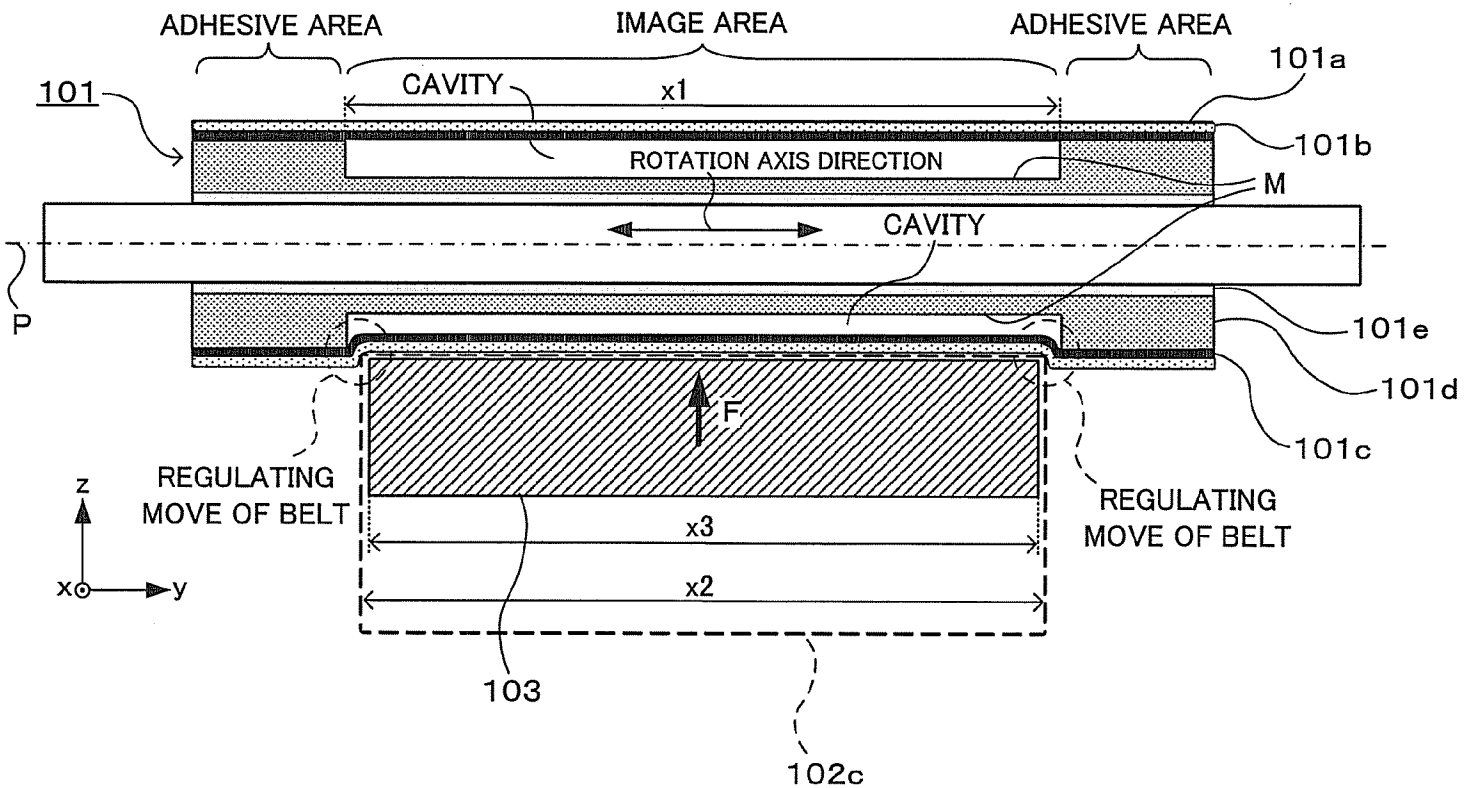
FIG. 3 is a drawing to show the cross section of the roller 101 on a perpendicular plane passing through the rotation axis of the roller 101 in the fixing apparatus according to the first embodiment of the invention.

The components making, up the fixing apparatus according to the embodiment will be discussed below in detail: FIG. 2 is a drawing to show the cross section of the roller 101 on a plane orthogonal to the rotation axis of the roller 101, and FIG. 3 is a drawing to show the cross section of the roller 101 on a perpendicular plane passing through the rotation axis of the roller 101 in the fixing apparatus according to the first embodiment of the invention.

Specifically, the roller 101 has a cross-sectional structure wherein a core 101*e*, an elastic layer (corresponding to an elastic roller) 101*d* made of silicon expanded rubber, a metal layer 101*c*, an elastic layer 101*b* made of silicon solid rubber, and a mold release layer 101*a* are laminated in order from the center.

The core 101*e* is formed of a material of iron, stainless steel, aluminum, etc., for example. The core 101*e* needs only to have a function as a shaft rotating on a rotation axis P and may be a solid structure or may be a hollow structure.

The elastic layer 101*d* is formed of a material resistant to heat and having elasticity, such as silicon expanded rubber, for example.

The elastic layer 101*d* can rotate on the rotation axis P and is formed with a concave shape groove M extending in the rotation direction on a roller face. The elastic layer 101*d* has a role in keeping the whole heat capacity of the roller 101 low by thermally insulating the metal layer 101*c* and the core 101*e* from each other.

The thickness of the elastic layer 101*d* in the rotation radius direction is set to a thickness of about 5 to 15 mm to keep wide the nip area formed between the roller 101 and the belt unit 102 and to keep such a distance for preventing a magnetic flux occurring from the induction heating coil from having an effect on the core 101*e*. Preferably, the hardness of the silicon expanded rubber forming the elastic layer 101*d* is ASKER-C20 to 40°, for example.

The metal layer 101*c* is formed of a material of nickel electrocast, etc., for example, and has a thickness in the rotation direction set to 30 to 50 μm, for example. Of course, the material of the metal layer 101*c* may be any if it is good in the heating efficiency of induction heating; for example, magnetic stainless steel or iron can also be adopted.

The elastic layer 101*d* in the roller 101 is formed with a tubular cavity having a predetermined length in the rotation direction (see FIG. 2) about the area where an image on a sheet passes through on the roller 101 considering an increase in the outer diameter caused by thermal expansion of the silicon expanded rubber at the heating time.

The elastic layer 101*d* formed with the groove M is covered with the metal layer 101*c* on the outer peripheral surface (roller face) in the rotation direction. The metal layer 101*c* is bonded to the outer periphery of the elastic layer 101*d* in an adhesive area shown in FIG. 3. Thus, the wall face of the groove formed in the elastic layer 101*d* and the metal layer 101*c* form the cavity.

The mold release layer 101*a* is formed of fluorocarbon resin of PFA, etc., for example, and has a layer thickness set to 0.05 to 0.2 mm, for example.

The outer periphery of the cavity provided in the roller 101 in the rotation radius direction (see FIG. 2) is covered with elastic body that can become deformed by an external press force, as described above.

The belt unit 102 abuts a belt 102*c* of a width x2 narrower than a width x1 of a cavity in the rotation axis P direction of the roller 101 against the roller face of the roller 101 so that it is positioned inside the range x1 in which the cavity is formed in the rotation axis P direction of the roller 101, and sandwiches a sheet 7 between the belt 102*c* and the roller 101 and transports the sheet 7. The belt 102*c* in the belt unit 102 is an endless belt placed on a plurality of rollers.

The press unit 103 has a role in pressing the belt 102*c* against the roller face from the position opposed to the roller face of the roller 101 through the belt 102*c* (see arrow F shown in FIG. 1).

A width x3 of the press unit 103 in the rotation axis P direction is set so that it becomes larger than the size of the sheet 7 to be transported (to which fixing treatment is applied) in the direction orthogonal to the transport direction. Accordingly, the whole sheet can be uniformly pressed against the roller 101 by the press force of the press unit 103 and occurrence of a fixing failure can be suppressed.

The width x3 of the press unit 103 in the rotation axis P direction is set so that it becomes larger than the size of the area where an image can be formed (a developer image can be formed) in the sheet 7 to be transported in the direction orthogonal to the sheet transport direction. Accordingly, at least the area where a developer image is formed on the sheet which must be reliably heated can be uniformly pressed against the roller 101 and occurrence of a fixing failure can be suppressed.

The width of the press unit 103 in the rotation axis P direction means specifically the width of the area pressed by the press unit 103 in the belt 102*c* (the area where the press unit 103 abuts the belt 102*c*). Here, the area where the press unit 103 abuts the belt 102*c* is the same as the size of the press unit.

The width of the press unit 103 in the rotation axis P direction is set smaller than the cavity formed in the roller 101 in the rotation axis P direction as understood from the condition described above, needless to say.

In the configuration, if the belt 102*c* of the belt unit 102 is pressed against the roller face, a dent is caused to occur by elastic deformation in the cavity portion of the roller face of the roller 101 (see FIG. 3). Then, the belt 102*c* narrower than the cavity is pressed against the roller 102 so as to fall within the range in which the cavity is formed as in the embodiment, whereby the belt 102*c* can be sunk in the dent. Accordingly, the position shift of the belt 102*c* in the rotation axis P direction is regulated and consequently the abutment position of the belt in the rotation axis P direction of the roller can be maintained at the regular position.

As shown in the embodiment, in the configuration adopting the roller formed with the cavity to absorb variations in the nip area range or the nip strength caused by an increase in the outer diameter of the roller caused by thermal expansion, the area where the cavity is formed in the roller can also be used for regulating the position shift of the belt.

Further, in the configuration for preventing the belt from shifting in the rotation axis direction of the roller, a strong frictional force acts on the side end part of the belt and there is a problem in the life of the belt. However, the tension of the belt is used to sink the belt in the moderate dent on the roller face produced by the press force as in the configuration of the embodiment, whereby the position shift can be suppressed without imposing excessive load on the belt.

The roller formed with the cavity therein is used as in the embodiment, whereby the frictional force added to the belt pressed against the roller can be lessened, resulting in contributing to the longer life of the belt.

The means for suppressing shift of the belt is provided by the cavity in the roller and the press unit placed inside the endless belt, so that downsizing of the apparatus is not hindered.

Second Embodiment

Subsequently, a second embodiment of the invention will be discussed.

The second embodiment of the invention is a modified example of the first embodiment described above and differs from the first embodiment in placement of heating means in configuring a fixing apparatus. Parts having identical functions with those previously described in the first embodiment are denoted by the same reference numerals in the second embodiment and will not be discussed again.

Figure 4:
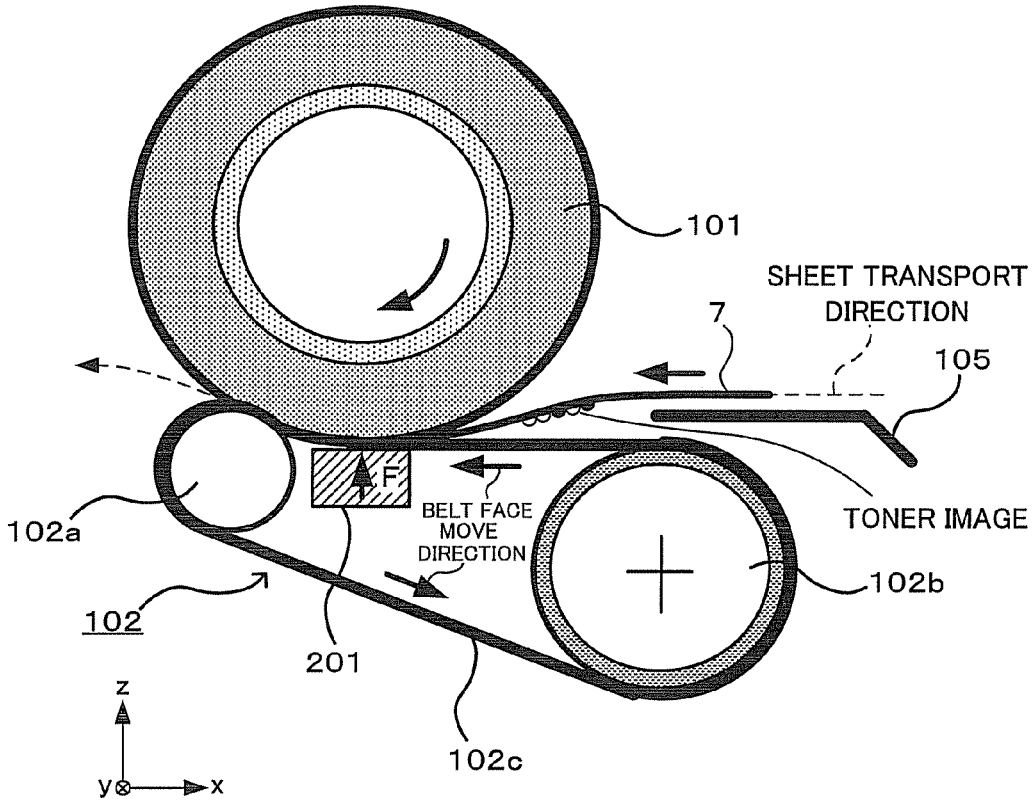
FIG. 4 is a drawing to show the configuration of a sheet transport apparatus and a fixing apparatus including the sheet transport apparatus according to a second embodiment of the invention.

FIG. 4 is a drawing to show the configuration of a sheet transport apparatus and a fixing apparatus including the sheet transport apparatus according to the second embodiment of the invention.

As shown in the figure, in the embodiment, a ceramic heater 201 (corresponding to a belt heating unit) for fixing a developer image on a sheet at the fixing treatment time is placed on a side of a belt 102*c* in a belt unit 102 not opposed to a roller face (see FIG. 4) for heating a sheet 7 to be transported through the belt 102*c*. Therefore, in the embodiment, a roller 101 has a role as a pressurization roller.

The ceramic heater 201 is placed so as to abut the belt face on the side of the belt 102*c* not opposed to the roller face, whereby "surf fixing treatment" is realized. In the embodiment, preferably the belt 102*c* uses a material having a small heat capacity to efficiently transmit heat from the ceramic heater 201 to the sheet 7.

The portion of the ceramic heater 201 abutting the belt face on the side of the belt 102*c* not opposed to the roller face is formed like a flat face. Accordingly, the area where the ceramic heater and the belt face are brought into intimate contact with each other can increase, contributing to improvement of the heating efficiency.

In the embodiment, the roller 101 bears the role as a pressurization roller and thus needs not necessarily to have a similar limination structure to that in the first embodiment and may be of a different structure if a pressurization characteristic required for pressing a sheet against a belt can be realized.

The configuration of the roller 101 in each of the embodiments described above is not limited to the example configuration; at least the outside in the rotation radius direction from the cavity portion formed in the roller needs only to be formed of a material that can become elastically deformed by the press force of the press unit or the belt heating unit.

In addition, an image formation apparatus (MFP: Multi Function Peripheral) including the fixing apparatus described above in each embodiment can also be provided, needless to say.

While the specific forms of the invention have been described in detail, it is to be understood that various changes and modifications will be apparent to those skilled in the art without departing from the spirit and the scope of the invention.

As described above in detail, according to the invention, there can be provided the sheet transport technique of clamping and transporting a sheet by the roller and the belt abutted against the roller, the technique capable of suppressing shift of the belt in the rotation axis direction of the roller without hindering downsizing of the apparatus.

What is claimed is:

1. A fixing apparatus comprising:

a belt configured to rotate on a rotation axis; and a roller comprising an elastic outer periphery to cover a concave shape groove, the elastic outer periphery and the belt to nip a sheet, the concave shape groove wider than the belt in a direction parallel to the rotation axis.

2. The apparatus of claim 1, wherein the roller comprises a metal layer under the elastic outer periphery.

3. The apparatus of claim 1, further comprising a press unit narrower than the belt in the direction configured to press the belt against the roller.

4. The apparatus of claim 1, wherein the belt is an endless belt wrapped around a plurality of rollers.

5. The apparatus of claim 1, wherein the concave shape groove is positioned at the center of the roller in the direction of the roller's rotation axis.

6. An image forming apparatus comprising:

a image forming unit configured to form an image in a target area of image forming on a sheet;

a belt configured to rotate on a rotation axis; and a roller comprising an elastic outer periphery to cover a concave shape groove, the elastic outer periphery and the belt to nip the sheet, the concave shape groove wider than the belt in a direction parallel to the rotation axis.

7. The apparatus of claim 6, wherein the roller comprises a metal layer under the elastic outer periphery.

8. The apparatus of claim 6, further comprising a press unit narrower than the belt in the direction configured to press the belt against the roller.

9. The apparatus of claim 6, further comprising a press unit wider than the target area in the direction.

10. The apparatus of claim 6, wherein the belt is an endless belt wrapped around a plurality of rollers.

11. The apparatus of claim 6, wherein the concave shape groove is positioned at the center of the roller in the direction of the roller's rotation axis.

12. A fixing method in an image forming apparatus, the apparatus comprising an image forming unit, a belt, a roller and a coil, a image forming unit configured to form an image in a target area of image forming on a sheet, the belt configured to rotate on a rotation axis, the roller comprising an elastic outer periphery to cover a concave shape groove, the elastic outer periphery and the belt to nip a sheet, the concave shape groove wider than the belt in a direction parallel to the rotation axis the method comprising:

forming the image on the sheet;

pressing the belt against the roller in the range of the cavity in the direction; and nipping and transporting the sheet with the elastic outer periphery and the belt.

* * * * *